US005361742A

United States Patent [19]

Briggs et al.

[11] Patent Number: 5,361,742

[45] Date of Patent: Nov. 8, 1994

[54] FUEL PUMP MANIFOLD

[75] Inventors: Paul F. Briggs, Wolcott; George H. Bucci, S. Windsor; Lawrence E. Egle, E. Hampton, all of Conn.

[73] Assignee: Walbro Corporation, Cass City, Mich.

[21] Appl. No.: 14,704

[22] Filed: Feb. 8, 1993

[51] Int. Cl.[5] ..... F02M 37/04

[52] U.S. Cl. ..... 123/506; 123/514; 123/497

[58] Field of Search ..... 123/497, 514, 506, 510, 123/512

[56] References Cited

U.S. PATENT DOCUMENTS

| | | | |
|---|---|---|---|
| 2,881,749 | 4/1959 | Pringham | 123/497 |
| 3,231,003 | 1/1966 | Richcreek | 123/457 |
| 4,044,746 | 8/1977 | Kaye | 123/514 |
| 4,062,336 | 12/1977 | Gant | 123/506 |
| 4,064,855 | 12/1977 | Johnson | 123/467 |
| 4,111,173 | 9/1978 | Skinner | 123/506 |
| 4,319,550 | 3/1982 | Ishii | 123/198 D |
| 4,450,820 | 5/1984 | Haynes | 123/514 |
| 4,546,745 | 10/1985 | Brotherston | 123/198 D |
| 4,971,017 | 11/1990 | Beakley | 123/198 D |
| 5,044,344 | 9/1991 | Tuckey et al. | 123/497 |
| 5,148,792 | 9/1992 | Tuckey | 123/497 |

*Primary Examiner*—Carl S. Miller

*Attorney, Agent, or Firm*—Barnes, Kisselle, Raisch, Choate, Whittemore & Hulbert

[57] ABSTRACT

A fuel pump manifold for a no-return fuel system for an automotive engine. The manifold has inlet and outlet passages with a check valve which opens when fuel is supplied to the engine and closes to prevent reverse flow of fuel when the outlet pressure is greater than the inlet pressure and a vent valve between the outlet and inlet and in parallel with the check valve which is normally closed and opens when the outlet pressure exceeds the inlet pressure by at least a predetermined minimum value which is usually the desired minimum pressure of fuel supplied to the operating engine when idling. Preferably, a normally closed pressure relief valve also communicates with the outlet to relieve overpressure of the outlet fuel supplied to the engine.

15 Claims, 1 Drawing Sheet

FUEL PUMP MANIFOLD

FIELD OF THE INVENTION

This invention relates to automotive engine fuel systems and more particularly to a fuel pump manifold for a returnless fuel system.

BACKGROUND OF THE INVENTION

U.S. Pat. No. 5,044,344 discloses a fuel system for an internal combustion engine of an automobile with a fuel pump module in a fuel tank and connected by only a fuel delivery line to the fuel rail and injectors of an engine. The speed of an electric motor driving a fuel pump is varied by electronic circuitry to maintain constant the fuel pressure at the injectors while automatically compensating for the quantity of fuel delivered to the injectors. This fuel system does not have any fuel return line from the rail or injectors to the fuel tank and is often referred to as a no-return fuel system. A manifold of the fuel pump has a check valve which maintains fuel pressure at the rail and injectors when the engine and pump are shut off and a relief valve which bleeds fuel into the tank in the event the rail and injectors are subjected to an overpressure condition.

SUMMARY OF THE INVENTION

In some engines, it is desirable to vary the fuel pressure at the injectors under different operating conditions. At full throttle, it is desirable for the injector fuel pressure to be substantially greater than at idle. When such an engine rapidly goes from full throttle to idle, the injector fuel pressure should be reduced immediately to avoid an overly rich fuel to air mixture which would result in poor engine performance and excessive engine exhaust emissions.

To reduce the fuel pressure at the injectors under some engine operating conditions, a fuel pump manifold with a check valve preventing reverse flow of fuel supplied to the engine has a bypass vent valve which bleeds fuel back to the outlet side of the fuel pump to thereby reduce the pressure of fuel supplied to the engine. This avoids parasitic loss of fuel and system inefficiencies when the engine and fuel system are operating under load conditions. Preferably, the manifold also has an overpressure relief valve which reduces the system pressure by discharging fuel directly into the tank.

Objects, features and advantages of this invention are to provide a fuel pump manifold for a no-return fuel system which reduces the pressure of fuel supplied to the injectors in response to certain engine operating conditions, avoids supplying excessive fuel to the engine under certain operating conditions, decreases engine emissions, and is rugged, durable, maintenance free, of relatively simple design and economical manufacture and assembly, and has a long in-service useful life.

BRIEF DESCRIPTION OF THE DRAWINGS

These and other objects, features and advantages of this invention will be apparent in view of the following detailed description of the best mode, appended claims and accompanying drawings in which:

DETAILED DESCRIPTION

Figure 1:
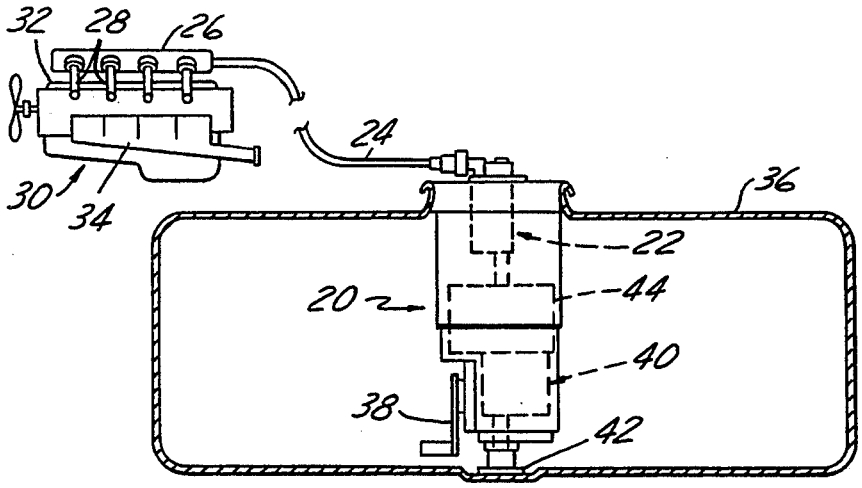
FIG. 1 is a schematic view of a fuel pump module with a manifold therein embodying this invention received in a fuel tank and connected to a fuel rail and ejectors of an internal combustion engine for an automotive vehicle.

Referring in more detail to the drawings, FIG. 1 illustrates a fuel pump module 20 with a fuel manifold 22 embodying this invention connected by a fuel line 24 to a fuel rail 26 and fuel injectors 28 of an internal combustion engine 30 with an air intake manifold 32 and an exhaust manifold 34 for an automotive vehicle, such as an automobile. In assembly, the pump module is mounted in a fuel tank 36 and has a fuel level sensor 38 and a fuel pump 40 with an outlet connected to the manifold and an inlet communicating with the bottom of the tank through a fuel filter 42. The pump is driven by an electric motor 44, the speed of which may be varied to control the pressure of fuel delivered by the pump to the engine. The fuel system does not have any fuel return line from the engine to the fuel tank and is often referred to as a no return fuel system.

Figure 2:
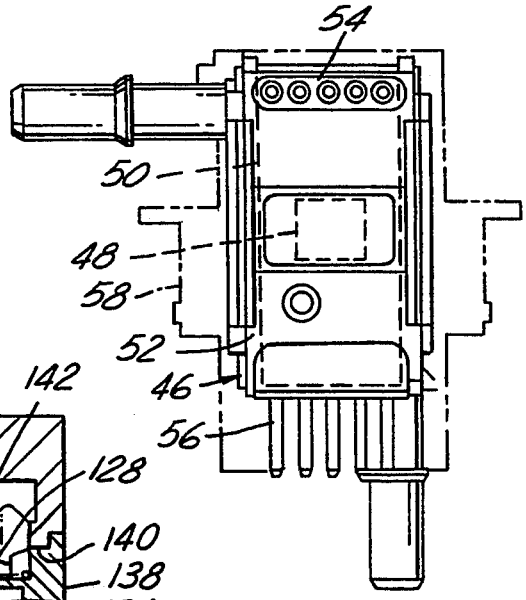
FIG. 2 is a side view of the manifold embodying this invention encapsulated in a cover of the fuel pump module.

As shown in FIGS. 1 and 2, the manifold 22 has a housing 46 preferably molded of a synthetic resin with a pressure transducer assembly 48 and a printed circuit board 50 therein enclosed by an outer cover 52. The circuit board has electronic circuits which vary and control the speed of the electric drive motor 44 and hence the output of the fuel pump 40 in response to signals from the fuel pressure transducer 48 and various signals from an engine control module which typically contains a central processing unit controlling operation of the engine. Electric signals and operating power are supplied to the circuit board through a connector assembly 54 and electric current is supplied to the pump motor and a signal is received from the level sensor through an electrical connector assembly 56. Preferably, the manifold is encased or potted by injection molding around it a cover or top cap 58 of the pump module of a synthetic resinous material such as acetyl.

Preferably, the pressure transducer is a capacitive transducer of the type disclosed and claimed in copending U.S. application Ser. No. 07/984,896, filed on Dec. 2, 1992. Preferably, the sensor and control circuitry is of the type disclosed and claimed in copending U.S. application Ser. No. 08/014,703, filed on Feb. 8, 1993. The disclosures of these applications are incorporated herein by reference and hence the pressure transducer and circuitry will not be described in further detail herein.

Figure 3:
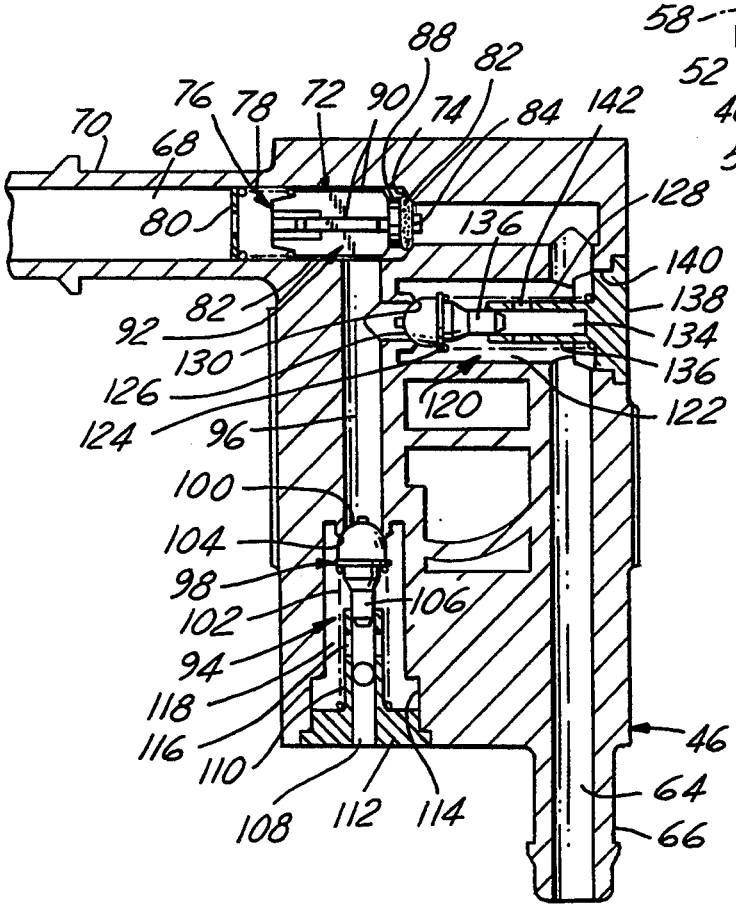
FIG. 3 is a sectional view of the manifold illustrating the fuel passages and valves thereof.

As shown in FIGS. 2 and 3, the housing has a fuel inlet passage 64 and connector 66 which in assembly is connected to the outlet of the fuel pump. The manifold also has a fuel outlet passage 68 communicating with the inlet passage and an outlet connector 70 which in assembly is connected to the fuel delivery line 24. When the engine and fuel pump are shut down, the pressure of the fuel in the outlet passage 68 and delivery line is maintained by a normally closed check valve assembly 72 which opens when the fuel pump is energized and supplies fuel to the outlet passage.

The check valve assembly has a seat 74 which is preferably molded in the housing, and a valve body 76 slidably received in the passage 68 and yieldably biased to its closed position by a spring 78 retained by a star washer 80 press fit in the passage 68. To provide a seal, the valve body 76 has an O-ring 82 received over a bulbous stud 84 and resting on a disk 88 on the valve body. The valve body also has four axially extending and radially projecting ribs 90 equally circumferentially spaced apart and arranged in a cross or generally X-shape cross section. When the valve is closed, the O-ring 82 bears on the seat 74 to provide a seal and, when the valve is open, fuel flows around the O-ring and the disk and through the spaces 92 between the ribs. The preload force produced by the spring 78 and its spring rate are determined and selected so that the valve 72 will open at a pressure well below the minimum fuel injector operating pressure (which is usually in the range of about 20 to 40 psig) such as 2–5 psig.

To protect the fuel system from over pressure, a normally closed relief valve assembly 94 is disposed in a passage 96 which communicates with the outlet passage 68 downstream of its check valve 72 and with the fuel module 20 and thence the fuel tank 30 by opening to the exterior of the housing 46. The relief valve assembly 94 has a valve body 98 with a hemispherical valve head 100 yieldably biased by a compression spring 102 into sealing engagement with a complementary seat 104 which is preferably spherical and molded in the housing 46. To guide and axially align the valve head with the seat, the body has a stem 106 slidably received in a bore 108 through a shank 110 of a retainer cap 112 press fit into a counterbore 114 in the housing. To permit fuel to be discharged through the bore 108, it communicates through ports 116 with the counterbore 118 in the housing. Preferably, to stabilize the spring and limit the extent to which the spring can laterally deflect from its axis as the valve opens and closes, the shank 110 projects into the spring and has an outside diameter which is only slightly smaller than the inside diameter of the spring. The extent to which the valve can be opened is limited by the valve body abutting the free end of the shank.

Preferably, the stem 106 of the valve body is brass and the hemispherical head 100 is a molded fluorolsilicone resin or other synthetic resin highly resistant to attack and deterioration by gasoline, alcohol and diesel fuels and the contaminants normally found therein. The preload force produced by the spring 102 and its spring rate are determined and selected so that the relief valve 94 is normally closed and will open at a predetermined pressure which is usually about 10 to 15 psi greater than the maximum normal operating pressure of the fuel system which is usually about 40 to 60 psig. The relief valve protects the fuel system in the event there is a malfunction which causes the pump to continuously operate at maximum pressure or during periods of so-called "hot soaking" (with the engine either running or shut down) in which the temperature of the fuel, and hence its pressure, increases above the desired maximum operating pressure due to heat absorbed by the fuel. In some vehicles, if there is a malfunction in the fuel system, the engine control module is programmed to cause the fuel pump to operate at maximum pressure so that the vehicle can "limp home" or be operated and driven to a service station for repair of the malfunction.

In some engines, the fuel pressure at the injectors is varied in response to engine manifold pressure to maintain a substantially constant differential pressure across the injectors. This results in a fuel line pressure and fuel pump pressure which varies relative to atmospheric pressure as engine load factors change. For example, from full throttle to idle conditions, the fuel line pressure may vary from 40 to 30 psig. When such engines rapidly go from full throttle to idle, it is desirable to immediately reduce the pressure of the fuel supplied to the engine to substantially the lowest normal fuel pressure (i.e. 30 psig) to avoid an overly rich fuel to air mixture. This may be accomplished by a vent valve assembly 120 disposed in a passageway 122 communicating with the fuel outlet downstream from its check valve 72 and the fuel inlet downstream of the fuel pump.

The vent valve assembly 120 has a valve body 124 with a hemispherical valve head 126 yieldably biased by a compression spring 128 into sealing engagement with a complementary seat 130 which is preferably spherical and molded in the housing 46. To guide and axially align the valve head with the seat, the body has a stem 132 slidably received in a blind bore 134 in a shank 136 of a cap 138 press fit in a counterbore 140 in the housing. The bore 134 in the shank communicates with the passage 122 through relief ports 142. The extent to which the valve can open is limited by it bearing on the free end of the shank. To stabilize and limit lateral deflection of the spring as the valve opens and closes, the spring is slidably received over the shank which preferably has an outside diameter only slightly smaller than the inside diameter of the spring. Preferably, the stem 132 is of brass and the valve head 126 is a molded synthetic resin highly resistant to attack by fuels such as a fluorosilicone synthetic resin.

The valve 120 is normally closed and opens to bleed fuel into the inlet passage 64 in response to the fuel pressure produced by the pump dropping sufficiently below the outlet fuel line pressure. Typically, when the engine load is reduced to idle, the valve is opened to reduce the pressure of the fuel in the outlet 68 to the low end of the normal range of fuel pressure or the pressure desired for engine idle operating conditions. For example, if the fuel pressure during normal engine operation conditions is in the range of about 30 to 40 psig, the valve may open when the throttle is reduced to idle to reduce the pressure to about 30 psig. This may be accomplished by the valve 120 and spring 128 being designed so that its preload force and spring rate permits the valve to open with a differential pressure of 30 psi. Preferably, to insure the valve remains closed under engine load conditions, the active area of the valve on its inlet passage side is greater than its active area on its outlet passage side. Usually, the area on the inlet side is 2 to 10 and preferably about 3 to 5 times greater than the area on the outlet side.

This vent valve assembly 120 avoids parasitic losses when the engine is operating under load conditions by remaining closed so that there is no bleeding of fuel from the outlet passage. Furthermore, when open by bleeding through the inlet passage and Dump, valve 120 insures the inlet passage and pump chambers are full of fuel so there is no interruption in supplying fuel when the engine is again subjected to load conditions. When a vehicle with a manual transmission is being shifted, throttle changes occur rapidly from load to idle and idle to load conditions.

The construction and arrangement of valve assemblies 74 & 120 has been found empirically when cycled many times to repeatedly open at the same preload pressure (compared to disc valves which drift about 10 psi ) and accommodate high fuel flow rates of 120 liters per hour with the seat having a through passage of about 0.153 of an inch and a spherical radius of about 0.020 of an inch. The manifold may be relatively small.

In one practical embodiment, the housing is about 1" deep, $1\frac{1}{4}$" wide and $1\frac{1}{2}$" high, excluding the inlet and outlet conduits projecting beyond the housing.

In use, the pressure of the fuel in the inlet 64 and hence the pressure of the fuel supplied by the pump is sensed by the capacitive transducer 48 which produces a signal indicative of and varying with changes in the fuel pressure. The transducer signal is processed and used by circuitry in the printed circuit board 50 along with signals from an engine control module to vary the speed of the electric motor 44 driving the fuel pump 40 and hence the pressure of fuel supplied through the manifold 22 to the engine in response to the load on the engine and other engine operating conditions.

Under certain engine operating conditions, when the pressure is momentarily greater than desired of the fuel supplied to the engine, such as rapidly going from full load to idle conditions, the pressure vent valve 120 opens to reduce to a predetermined value the pressure of the fuel supplied to the engine. The valve 120 opens when the speed of the fuel pump is reduced sufficiently so that the pressure of fuel in the inlet passage 64 decreases to the point where the pressure differential between the outlet 68 and the inlet 64 exceeds the preload applied by the spring 128 to the valve. For example, if the outlet pressure is 40 psig and the valve 120 is preloaded to open at 30 psig, it will open when the fuel pump reduces the inlet pressure in passage 64 to less than 10 psig. Due to this pressure differential, the check valve 72 is closed while the vent valve 120 is open. When the speed of the fuel pump is increased, the inlet fuel pressure increases which rapidly decreases and eliminates this pressure differential, thereby causing the vent valve 120 to close and when the inlet pressure exceeds the outlet pressure the check valve 72 to open to supply fuel through the outlet 68 to the fuel line 24, rail 26 and injectors 28.

Under operating conditions, if there is a malfunction in the fuel system which results in fuel being supplied to the engine at an excessively high pressure, such as a malfunction of the engine control module or electronic circuitry which causes the pump to continuously operate at maximum pressure, the pressure relief valve 94 opens to dump excess fuel into the fuel tank. This insures that in spite of the malfunction, fuel will continue to be supplied to the engine (without damaging the fuel system) so that the vehicle can be driven to a service station for correction of the malfunction. Also, under so-called hot soak conditions, the fuel may be heated sufficiently to produce excessive pressure which would be relieved by opening of the pressure relief valve 94 to dump fuel into the gas tank. These hot soak conditions may occur either when the engine is operating, such as when idling for a long period of time in hot weather, or when the engine is shut down, such as by fuel absorbing heat from the hot engine injectors and fuel rail. When the engine and pump are turned off, this excessive pressure may also be relieved through the vent valve 120.

Under operating conditions, the fuel retention valve 72 is normally open and when the engine is turned off it closes to retain fuel in the outlet 68 and the engine fuel system under normal idle operating pressure for the next starting of the engine.

We claim:

1. A fuel manifold for a no-return fuel system for an automotive engine with at least one fuel injector and a variable pressure fuel pump comprising, a fuel inlet passage in said housing having a fuel inlet constructed and arranged to be connected to the outlet of the fuel pump, a fuel outlet passage in said housing and communicating with said fuel inlet passage downstream of said inlet, a check valve disposed in said outlet passage and constructed and arranged to be closed when the pressure of fuel in said outlet passage exceeds the pressure of fuel in said inlet passage, a vent passage communicating only with said outlet passage downstream of said check valve and said inlet passage downstream of said fuel inlet thereof and upstream of said check valve, and a vent valve disposed in said vent passage and constructed and arranged to be normally closed and to open in response to the fuel pressure in said outlet passage being greater than the fuel pressure in said inlet passage by at least a predetermined minimum value due to a decrease in the fuel pressure produced by the fuel pump.

2. The manifold of claim 1 wherein said vent valve comprises a check valve yieldably biased to its closed position with a preload providing such predetermined minimum value which is substantially equal to the desired minimum outlet fuel pressure under engine idle operating conditions.

3. The manifold of claim 2 wherein said vent valve also comprises a spring providing such preload.

4. The manifold of claim 2 wherein said vent valve has an active area on its inlet passage side which is in the range of 2 to 10 times greater than its active area of its outlet passage side.

5. The manifold of claim 1 which also comprises a relief passage in said housing and communicating with the exterior thereof and with said outlet passage downstream of said outlet check valve, and a pressure relief valve disposed in said relief passage and constructed and arranged to be normally closed and to open when the pressure of fuel in said outlet passage exceeds a predetermined value which is greater than the normal maximum operating pressure of fuel in said outlet passage.

6. The manifold of claim 5 wherein said pressure relief valve is constructed and arranged to open when the pressure of fuel in said outlet passage exceeds the normal maximum operating pressure of fuel in said outlet passage by 5 to 15 psi.

7. The manifold of claim 5 wherein said pressure relief valve includes a spring yieldably biasing said relief valve to its normally closed position with a preload force controlling the predetermined value of the pressure of fuel in the outlet passage at which said relief valve opens.

8. For a no-return fuel system for an automotive engine with at least one fuel injector and an electric fuel pump the outlet fuel pressure of which varies as a function of the speed at which an electric motor drives the pump, a manifold system comprising a fuel inlet passage constructed and arranged to be connected with the outlet of the fuel pump, a fuel outlet passage communicating with said fuel inlet passage and constructed and arranged to be operably connected with at least one fuel injector of the engine, an outlet check valve disposed in said outlet passage and constructed and arranged to be closed when the pressure of fuel in said outlet passage exceeds the pressure of fuel in said inlet passage, a vent passage communicating only with said inlet passage downstream of the outlet of the fuel pump and said outlet passage downstream of said outlet check valve, and a vent valve disposed in said vent passage and constructed and arranged to be normally closed and to open in response to the speed of the fuel pump being decreased sufficiently so that the fuel pressure in said outlet passage becomes greater than the fuel pressure in said inlet passage by at least a predetermined minimum value.

9. The manifold system of claim 8 wherein said vent valve comprises a check valve yieldably biased to its closed position with a preload providing such predetermined minimum value which is substantially equal to the desired minimum outlet fuel pressure under engine idle operating conditions.

10. The manifold system of claim 9 wherein said vent valve also comprises a spring providing such preload.

11. The manifold system of claim 8 wherein said vent valve has an active area on its inlet passage side which is in the range of 2 to 10 times greater than its active area on its outlet passage side.

12. The manifold system of claim 8 which also comprises a relief passage communicating with said outlet passage downstream of said outlet check valve, and a pressure relief valve disposed in said relief passage and constructed and arranged to be normally closed and to open when the pressure of fuel in said outlet passage exceeds a predetermined value which is greater than the normal maximum operating pressure of fuel in said outlet passage.

13. The manifold system of claim 12 wherein said relief valve is constructed and arranged to open when the pressure of fuel in said outlet passage exceeds the normal maximum operating pressure of fuel in said outlet passage by 5 to 15 psi.

14. The manifold system of claim 12 wherein said pressure relief valve includes a spring yieldably biasing said relief valve to its normally closed position with a preload force controlling the predetermined value of the pressure of fuel in the outlet passage at which said relief valve opens.

15. A no-return fuel system for an automotive engine with at least one fuel injector comprising, an electric fuel pump the outlet fuel pressure of which varies as a function of the speed at which an electric motor drives the pump, a manifold having a fuel inlet passage connected with the outlet of the fuel pump, a fuel outlet passage communicating with said fuel inlet passage and constructed and arranged to be operably connected with at least one fuel injector of the engine, an outlet check valve disposed in said outlet passage and constructed and arranged to be closed when the pressure of fuel in said outlet passage exceeds the pressure of fuel in said inlet passage, a vent passage communicating only with said inlet passage downstream of the outlet of the fuel pump and said outlet passage downstream of said outlet check valve, and a vent valve disposed in said vent passage and constructed and arranged to be normally closed and to open in response to the speed of the fuel pump being decreased sufficiently so that the fuel pressure in said outlet passage becomes greater than the fuel pressure in said inlet passage by at least a predetermined minimum value.

* * * * *